US007364101B2

(12) United States Patent
Tanaka et al.

(10) Patent No.: US 7,364,101 B2
(45) Date of Patent: Apr. 29, 2008

(54) PULVERIZING APPARATUS AND METHOD FOR PULVERIZING

(75) Inventors: Tetsuya Tanaka, Suntou-gun (JP); Nobuyasu Makino, Numadu (JP); Hideyuki Santo, Numadu (JP)

(73) Assignee: Ricoh Company, Ltd., Tokyo (JP)

( * ) Notice: Subject to any disclaimer, the term of this patent is extended or adjusted under 35 U.S.C. 154(b) by 229 days.

(21) Appl. No.: 11/190,934

(22) Filed: Jul. 28, 2005

(65) Prior Publication Data

US 2006/0024607 A1 Feb. 2, 2006

(30) Foreign Application Priority Data

Jul. 28, 2004 (JP) ..... 2004-219990
Jul. 14, 2005 (JP) ..... 2005-205915

(51) Int. Cl.
*B02C 19/06* (2006.01)
*B02C 23/08* (2006.01)

(52) U.S. Cl. ..... 241/79.1; 241/5; 241/39

(58) Field of Classification Search ..... 241/79.1, 241/5, 39

See application file for complete search history.

(56) References Cited

U.S. PATENT DOCUMENTS 6,224,004 B1 * 5/2001 Kato et al. ..... 241/39
2003/0178514 A1 9/2003 Makino et al.
2004/0251330 A1 12/2004 Takahashi et al.
2006/0024607 A1 2/2006 Tanaka et al.

FOREIGN PATENT DOCUMENTS

JP 2004-160371 * 10/2004

OTHER PUBLICATIONS

U.S. Appl. No. 11/752,562, filed May 23, 2007, Kubota et al.

* cited by examiner

*Primary Examiner*—Faye Francis
(74) *Attorney, Agent, or Firm*—Oblon, Spivak, McClelland, Maier & Neustadt, P.C.

(57) ABSTRACT

A pulverization/classification apparatus includes a plurality of air nozzles, a milling chamber as a space for pulverizing particles by compressed air jetted by the air nozzles, and a rotor installed at an upper part of the milling chamber that classifies powder materials flowing into the rotor from the milling chamber with centrifuging into fine particles and coarse particles. The rotor includes plural blade members, and a width of the blade members within the rotor are set to be 1/50-2/25 of the rotor's diameter.

26 Claims, 6 Drawing Sheets

PULVERIZING APPARATUS AND METHOD FOR PULVERIZING

BACKGROUND OF THE INVENTION

1. Field of the Invention

The present invention relates to a fluidized bed type pulverization/classification apparatus for manufacturing a powder, which may particularly be a toner powder, and a method of manufacturing the powder using the pulverization/classification apparatus.

2. Discussion of the Background

Background fluidized bed type pulverization/classification apparatuses typically have a cylindrical shape and include a vessel. In addition, plural air nozzles are provided on lower portions of an inner wall of the vessel to discharge a high pressure jetted air. In the cylindrical vessel, particles of a toner raw material (i.e., a toner constituent mixture) are suspended by the high pressure jetted air so as to collide with each other and thereby be pulverized. To efficiently perform pulverization while preventing excessive pulverization, the pulverized toner raw material needs to be rapidly fed to a classifier so that desired toner particles having a small particle diameter in a proper desired diameter range can be extracted.

FIG. 3 illustrates a background fluidized bed type pulverization/classification apparatus. Referring to FIG. 3, particles of the toner raw material are fed from a raw material feeder 1 into a cylindrical vessel of a milling chamber 4 by high pressure jetted air fed by an air feeder (not shown) and discharged from plural air nozzles 5. The toner raw material particles collide with each other at crossing points of the jetted air streams generally around the axis 17 of the air nozzles 5 of the milling chamber 4, resulting in pulverization of the toner raw material particles.

The toner raw material particles stay within the cylindrical vessel for a predetermined time while circling therein with this operation. After the pulverization is repeated, the pulverized toner raw material particles are fed by an upward current to a classification rotor 3, which is provided on an upper portion of the cylindrical vessel of milling chamber 4.

The classification rotor 3 classifies the toner raw material particles into particles having a particle diameter in a desired particle diameter range (fine particles that can be discharged using a blower) and coarse particles. The particles having a particle diameter within the desired diameter range can be output from the outlet or exhaust tube 2, and then can be used as a toner in the form of a final product. Coarse particles are fed again by the centrifugal force of the classification rotor 3 back into the cylindrical vessel of milling chamber 4 to be again subjected to the pulverization treatment. By repeating these operations, the toner raw material particles can be converted into particles of a desired size for a final toner product.

If the amount of the particles in the milling chamber 4 are stabilized, the system can operate for a continuous pulverization.

When a final toner powder product having a small particle diameter is manufactured using a fluidized bed type pulverization/classification apparatus and method, the following problems tend to occur:

(1) Continuation of pulverization in a milling chamber is required to prepare the fine particles; and (2) Coarse particles (having a particle diameter generally not less than about 12 μm) tend to be included in the final toner product. Particularly, the content of such coarse particles in a final toner product prepared by the background fluidized bed pulverization/classification apparatus and method tends to be considerably high.

Japanese Laid-open patent publication No. 11-226443 and Japanese Laid-open patent publication No. 2000-005621 disclose pulverization apparatuses for expedited pulverization. As a device to improve crush efficiency, JP 11-226443 discloses an apparatus having an up-and-down movable drawer bottom so that the surface of the particles that have accumulated on the drawer bottom are held at a current air spout position of a nozzle. However, such a structure does not solve the above-noted problems because nothing is changed in the behavior of the particles from other background art. Further, continuing crushing in the milling chamber in such a device is still necessary to obtain the desired particle size.

JP 2000-005621 discloses an apparatus including a collision member at a center of an axis of the milling chamber. Such an apparatus adopts a particle collision member method. However, in such a device for a collision between the collision member and particles the apparatus needs to intensify the pressure and velocity of air output from air nozzles.

Japanese Laid-open patent publication No. 2004-160371 discloses an apparatus to improve efficiency of pulverizing in which compressed air is jetted from air nozzles to cause a first collision with particles. Further, a second collision member is provided above or below the first colliding position. With such an apparatus collision pulverizing efficiency in a crushing chamber improves. In addition, particles within the desired range can be obtained and pulverizing can be performed with high efficiency. However, in such a publication a shape of the rotor or any benefits achieved by using a rotor of a specific shape is not disclosed.

SUMMARY OF THE INVENTION

The present inventors have recognized that pulverizing efficiency of a fluidized bed type pulverization/classification apparatus can be improved by optimizing a shape or size of a rotor, which will also operate to improve the accuracy of obtaining particles of a desired size.

The above-mentioned background fluidized bed type pulverization/classification apparatuses can be improved by optimizing a shape or size of a rotor, which will also operate to improve the accuracy of obtaining particles of a desired size.

The above-mentioned fluidized bed type pulverization/classification apparatuses as in Japanese Laid-open patent publication No. 11-226443 and Japanese Laid-open patent publication no. 2000-005621 focus on the air output from air nozzles. Both publications do not disclose specifics of a rotor system or address balance of centrifugal force and centripetal force of the rotor.

The present inventors recognized, for these reasons, that a need exists for a novel pulverizing apparatus that can process particles to be pulverized efficiently, improve efficiency of a collision in a milling chamber and a crush device, shorten the time to provide the crushing device, and crush particles to a desired size range with high efficiency.

Accordingly, an object of the present invention is to realize these and other objects by the present novel pulverization/classification apparatus including a plurality of air nozzles, a milling chamber as a space for pulverizing particles by compressed air jetted particles by the air nozzles, and a rotor installed at an upper part of the milling chamber that classifies powder materials flowing into the rotor from the milling chamber with centrifuging into fine particles and coarse particles. In addition, the present novel pulverizing apparatus includes plural air nozzles that give rise to primary collisions with powder materials, and the width of blades within the rotor are set to be 1/50-2/25 of the rotor's diameter.

A novel pulverizing method uses the above-noted novel pulverizing apparatus.

These and other objects, features, and advantages of the present invention will become apparent upon consideration of the following description of the preferred embodiments of the present invention taken in conjunction with the accompanying drawings.

BRIEF DESCRIPTION OF THE DRAWINGS

Various other objects, features, and attendant advantages of the present invention will be more fully appreciated as the same becomes better understood from the following detailed description when considered in connection with accompanying drawings in which like reference characters designate like or corresponding parts throughout, and wherein.

DETAILED DESCRIPTION OF THE PREFERRED EMBODIMENTS

The present invention will be explained referring to a pulverization/classification apparatus and method for manufacturing a toner, but the present invention is not limited to such a pulverization/classification apparatus and method.

The present invention realizes an increase in the centrifugal force of a rotor, prevents too much absorption of raw toner particles, and provides accurate classification of particles by the rotor. For a centrifugal force classification, the number of rotors utilized can be either singular or plural. The amount of particle redemption per hour from utilizing plural rotors may be much greater than that utilizing a singular rotor, and thus can provide an advantage.

As discussed below in further detail, in one feature in the present invention a shape and size of rotor blades are selected to provide enhanced operation. In a further feature discussed below a secondary collision mechanism is utilized to achieve a higher probability of pulverizing particles to a desirable size. In one feature also discussed below, the height of a collision member can be made to be adjustable. With such a structure, the present invention can be more flexible to match pulverizing conditions, for example of an average particle diameter and a throughput of particles of the pulverizing apparatus, to provide enhanced flexibility.

In addition, in one feature of the present invention plural air nozzles can be utilized, which can thereby increase the number of primary collisions between particles occurring, making for more efficient pulverizing.

An explanation of different pulverizing apparatuses of the present invention are now provided below.

Figure 2:
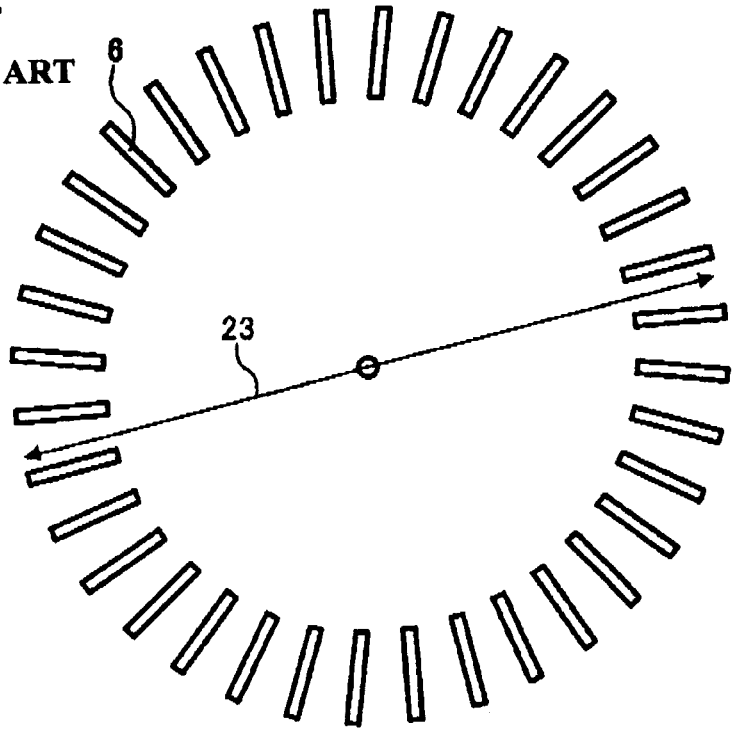
FIG. 2 BACKGROUND ART
FIG. 2 is a schematic cross-sectional view of blades of a rotor for use in a background fluidized bed-type pulverization apparatus.
Figure 3:
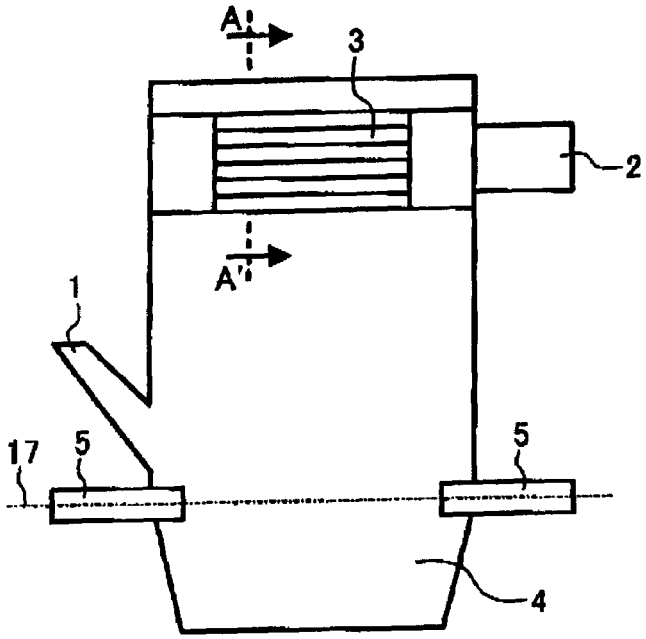
FIG. 3 BACKGROUND ART
FIG. 3 is a cross-sectional view of a background fluidized bed-type pulverization apparatus.

The background pulverizing apparatus in FIG. 3 includes a rotor 3, air nozzles 5, and a milling chamber 4 for milling particles. FIG. 2 is a cross-sectional view of the background rotor in FIG. 3 at line A-A'. As shown in FIG. 2, the rotor includes individual blade elements 6, and has an overall diameter indicated at 23.

Figure 1:
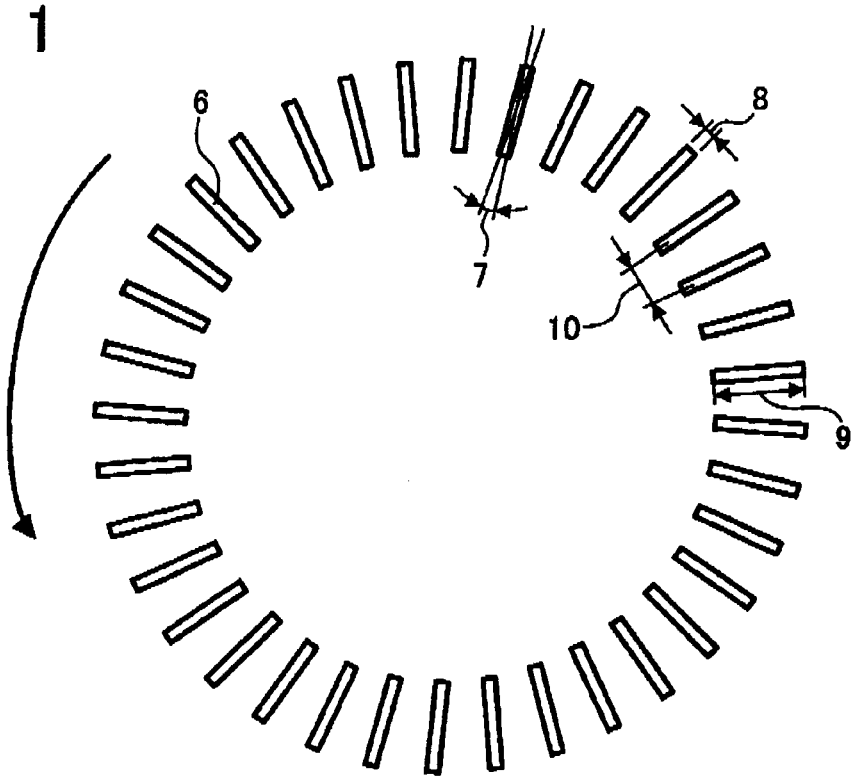
FIG. 1 is a schematic cross-sectional view of blades of a rotor for use in a fluidized bed-type pulverization apparatus of the present invention.

One feature in the present invention is to improve on the background rotor such as shown in FIG. 2 and to provide a novel rotor with unique properties that provide enhanced operations. The novel rotor in the present invention is shown in FIG. 1. Such a rotor can be positioned in a pulverizing apparatus of the present invention such as shown for example in FIG. 4 at the head of a milling chamber 4. The rotor of the present invention, which is positioned at the head of the milling chamber 4, divides pulverized particles from the milling chamber 4 into raw or fine particles by centrifugal force. The shape of the milling chamber 4 is not limited and can take many shapes. From a standpoint to supply particles uniformly, and to be able to output uniform toner powder, the milling chamber 4 is preferably cylindrical. The magnitude of the milling chamber 4 is also not restricted, but from the standpoint of being able to crush a large quantity of raw toner powder material effectively, a 100-1000 mm inside diameter and 300-3000 mm height are desirable, a 300-900 mm inside diameter and 700-2700 mm height are preferred, and a 500-800 mm inside diameter and 1000-2500 mm height are more preferred.

In the pulverizing apparatus of the present invention, plural air nozzles 5 are positioned at the milling chamber 4, which provide the function of generating primary collisions between the toner raw material particles fed from the intake 1 by generating collisions between the particles by the compressed air jetted from the plural air nozzles 5.

The number of air nozzles is not restricted, but utilizing 2-8 air nozzles is preferred, and utilizing 3-4 air nozzles is most preferred. A single air nozzle typically cannot sufficiently generate primary collisions from the input jetted compressed air. On the other hand, if there are too many air nozzles, the production process of the entire apparatus becomes more complicated, and there is also the possibility of more inefficient pulverization.

Figure 9:
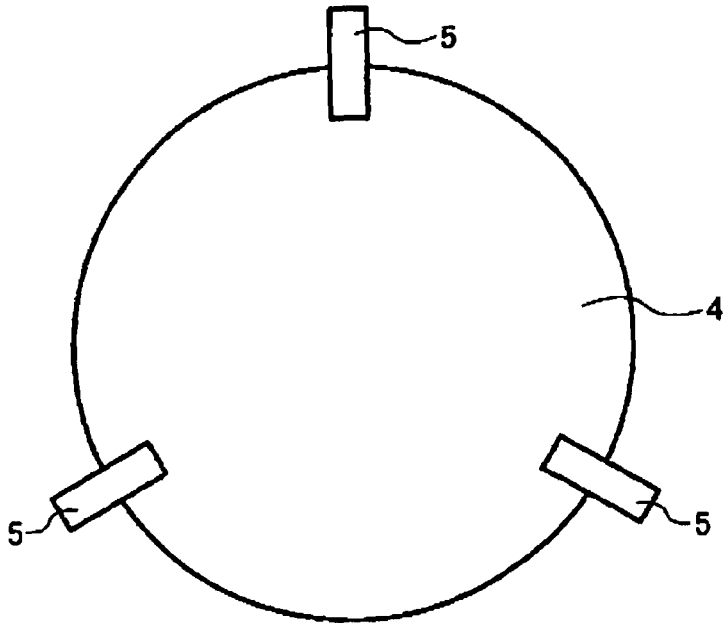
FIG. 9 is a schematic cross-sectional view of a pulverization apparatus with plural air nozzles of the present invention.

It is also preferable to set the air nozzles 5 at a concentric circle on or around their central axis 17 in the lengthwise direction of the milling chamber 4, as shown for example in FIG. 9. Therefore, compressed air jetted from the air nozzles 5 collides at a center in the milling chamber 4. As for the grading of the output direction of air from the air nozzles 5, and with reference to FIG. 10, an angle within 20 degrees from an evenness level is preferable, and maintaining air nozzles 5 within plus or minus 15 degrees from the evenness level is more preferable, and maintaining the air nozzles 5 within plus or minus 10 degrees from an evenness level is most preferable.

Figure 10:
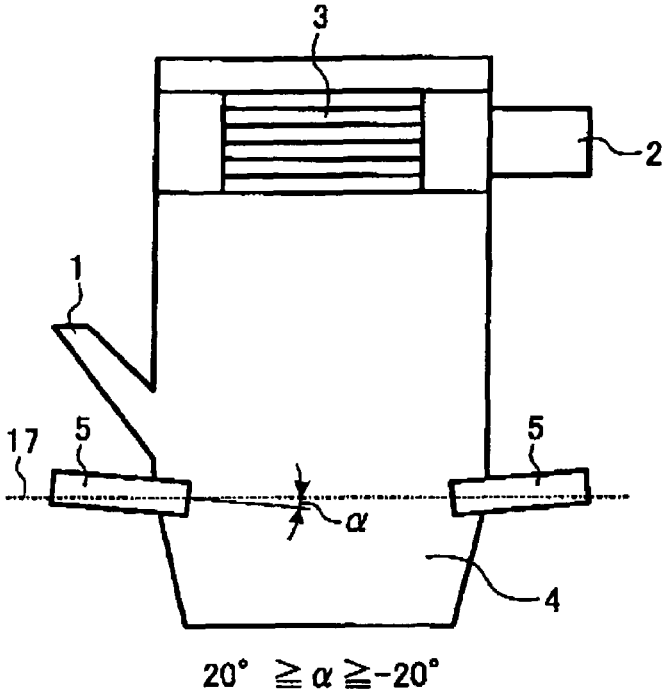
FIG. 10 is a schematic cross-sectional view of a pulverization apparatus showing a direction of orientation of air nozzles of the present invention.

That is, the gradient of the output air from the air nozzles 5 is shown as the angle α for example in FIG. 10, and is preferably between 20 degrees and −20 degrees. If the air nozzles 5 are more than 20 degrees from the evenness level, that may give rise to a possibility of inefficient pulverization.

Figure 11:
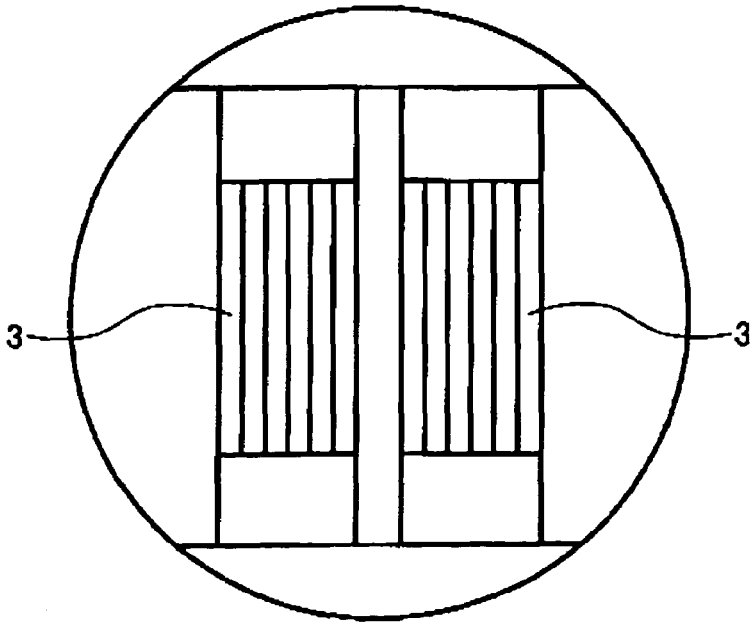
FIG. 11 is a view of an upper surface of a pulverization apparatus having plural rotors of the present invention.

Further, and with reference to FIG. 11, as for the number of rotors 3 to be utilized, utilizing 1-6 rotors is preferable, utilizing 1-4 rotors is more preferable, and utilizing 2-4 rotors is most preferable, as shown for example in FIG. 11 utilizing two rotors. If only a single rotor is utilized, the quantity of collected pulverized particles per hour may be limited. On the other hand, if too many rotors are utilized, the production process of the apparatus becomes more complicated, and if an interval between the plural rotors is too narrow, air currents within the rotors can be disturbed, which may lead to inefficient pulverization.

In specific examples of the pulverizing apparatus of the present invention discussed in further detail below, rotor 3 was set not to excessively aspirate raw particles with a particle diameter of 12 μm and above.

One feature in the present invention is to increase the centrifugal force provided by the rotor by controlling settings of an interspace between each blade within the rotor, controlling a width of the blades, controlling the length of the blades, and controlling an angle of the blades. By properly considering these factors, the pulverizing apparatus of the present invention can avoid excessive aspiration of raw particles and can provide precise classification of the particles.

With reference to FIG. 1, in a preferred embodiment of the present invention, the width of the plural blades 6, shown by reference numeral 8 in FIG. 1, is preferably 1/50-2/25 of the rotor diameter (see for example diameter 23 in FIG. 2), is more preferably 1/50-3/50 of the rotor diameter 23, and is most preferably 1/50-1/25 of the rotor diameter 23. When the width 8 of the blades 6 is too small, it becomes too easy for an air flow within the spaces between adjoining blades to have mutual influences. Further, in such a circumstance, the centrifugal force generated by rotation of the rotor 3 may become unstable, which gives a rise to the possibility of decreased pulverization. Moreover, when the width 8 of each blade 6 is too large, the number of blades 6 cannot be increased.

The above-mentioned blade width 8 is properly set by factoring in the rotor diameter, the rotational speed of the rotor, the pulverizing particle size used and desired, etc. The rotor diameter used here is an outside diameter of the rotor, see again reference numeral 23 in FIG. 2 in the present specification.

Moreover, the present inventors also recognized that the length of the plural blades 6 that form the rotor 3 (see reference numeral 9 in FIG. 1 as the length) is preferably 1/50 of the rotor diameter 23, and is more preferably 1/25-3/50 of the rotor diameter 23. When the blades 6 that form the rotor 3 are too short, not enough centrifugal force is obtained by their rotation. In addition, the flow velocity in the rotor 3 may increase when the blades 6 are too long. Such an increase of the flow velocity in the rotor 3 may adversely cause raw particles of 12 μm or more to be excessively aspirated.

The above-mentioned blade length 9 is also properly set by factoring in the rotor diameter, the rotational speed of the rotor, the pulverizing particle size desired and used, etc.

As for the spacings between different blades 6 (shown as reference numeral 10 in FIG. 1), that spacing is preferably 1/25-3/25 of the rotor diameter 23, is more preferably 1/25-2/25 of the rotor diameter 23, and is most preferably 1/25-3/50 of the rotor diameter 23. When the spacings 10 between one blade and the next blade are too narrow, resistance to aspiration increases, and not enough aspirating force is obtained. In addition, when the spacings 10 between one blade and a next blade are too narrow, not enough centrifugal force is generated, and raw particles of 12 μm or more may be excessively aspirated.

The spacings 10 between blades 6 is also properly set considering the rotor diameter, the rotational speed of the rotor, the pulverizing particle size used and desired, etc.

Moreover, the present inventors also recognized that properly setting the width angle of the plural blades 6 can provide increased results. The width angle of the blades 6 of the rotor 3 (shown as reference numeral 7 of FIG. 1) is preferably at an angle of 0-30 degrees compared with a radial of the rotor, is more preferably at an angle of 0-20 degrees, and is most preferably at an angle of 0-10 degrees.

The centrifugal force obtained by the rotation of the rotor 3 can be increased by utilizing such a width angle 7. On the other hand, air resistance of the blades 6 can grow when the above-mentioned angle 7 is too large, and thereby the blades 6 will need to be increased in strength. If the width angle 7 is too large, the rotor 3 may be unsuitable for high velocity revolution. Moreover, a problem that the number of blades 6 cannot be increased also results from too large of a width angle 7.

The width angle 7 of the blades 6 is also properly set based on the rotor diameter, the rotational speed of the rotor, the pulverized particle size used and desired, etc.

Figure 4:
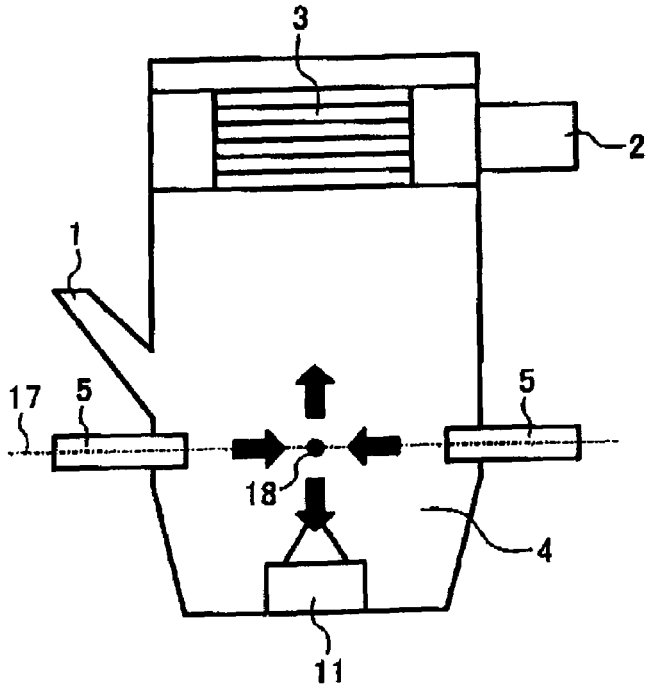
FIG. 4 is a cross-sectional view of an embodiment of a fluidized bed-type pulverization apparatus of the present invention.

In the embodiment of the pulverizing apparatus of the present invention as shown for example in FIG. 4, as a further feature in addition to utilizing specific rotor properties as noted above, a collision member can also be provided within the milling chamber 4. As shown for example in FIG. 4, a collision member 11 is provided within the milling chamber 4, which can result in increasing the probability of pulverization of the raw particles after they collide with each other by virtue of the air jetted from the nozzles 5. That is, the raw particles after colliding with each other (primary collision) can then collide with the collision member 11 to be further pulverized (secondary collision). Therefore, pulverizing efficiency in the milling chamber 4 may be improved.

In the embodiment in FIG. 4, the collision member 11 is set below the colliding point 18 at the center of the axis 17 of the air nozzles 5. That collision member 11 allows for secondary collisions of the particles, secondary to the particles colliding with each other, to increase the probability of pulverization.

Figure 5:
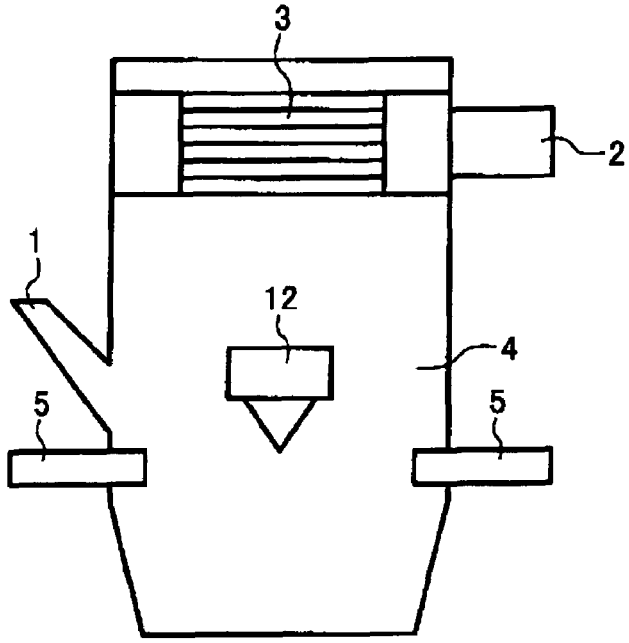
FIG. 5 is a cross-sectional view of an embodiment of a fluidized bed-type pulverization apparatus of the present invention.

As an alternative embodiment of the present invention shown for example in FIG. 5, a collision member 12 can be provided above the colliding position of the particles.

In a further embodiment of the present invention shown in FIG. 6, a first colliding member 11 can be provided below the collision position and a second colliding member 12 can be provided above the colliding position (see colliding position 18 in FIG. 4).

Further, the shape of the colliding members 11, 12 is not limited to specific shapes, but can take on various shapes.

The shapes of the colliding members 11, 12 just need to be selected so that the particles collide therewith as needed. One factor to consider in deciding the shapes of such colliding members 11 and 12 is their slip stream from the air jetted from the nozzles 5. With consideration of the interaction of the colliding members 11, 12 with such a slip stream, utilizing colliding members taking the shape of a cone or a cylindrical shape may be preferable.

Figure 7:
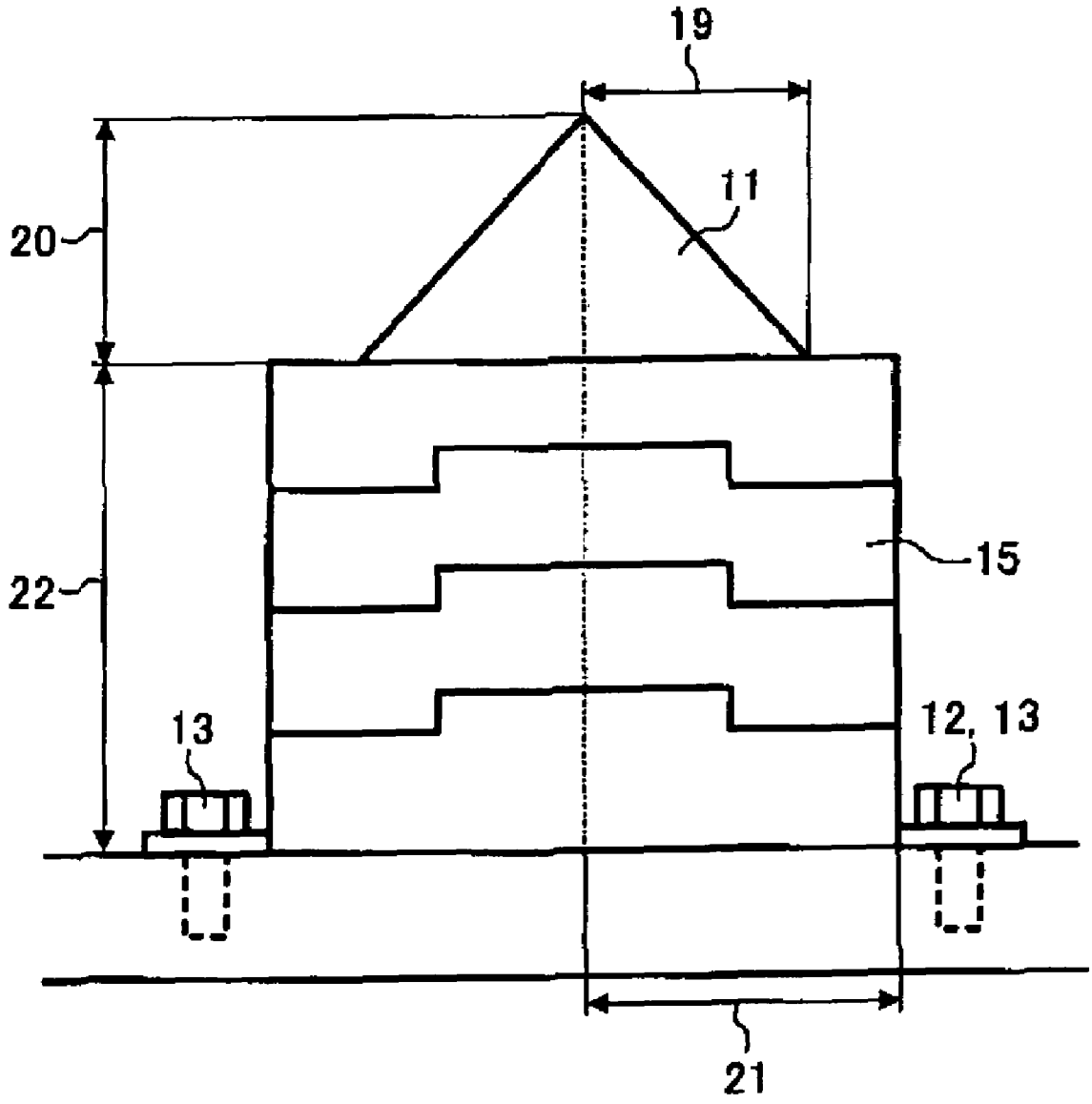
FIG. 7 is a schematic cross-sectional view of an embodiment of a secondary collision member of the present invention.
Figure 8:
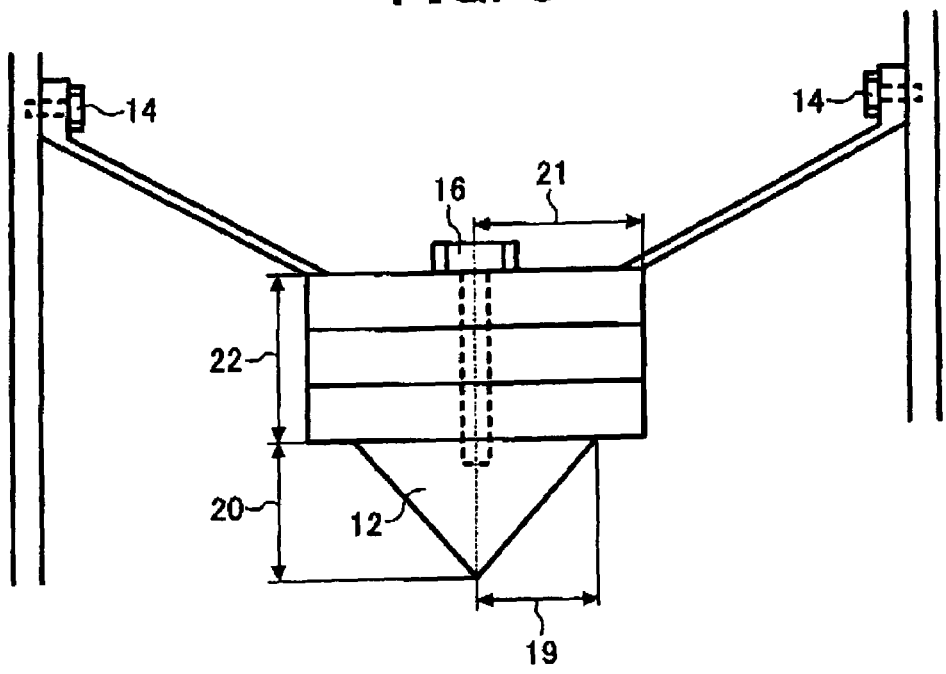
FIG. 8 is a schematic cross-sectional view of an embodiment of a secondary collision member of the present invention.

FIGS. 7 and 8 show specific embodiments of the colliding members 11, 12, showing their shape and construction.

As shown for example in FIGS. 7 and 8, the colliding members 11, 12 can be formed with a conic portion 20 and a base portion 22 formed of plural base members. In FIG. 7, the colliding member 11 is secured by bolts 13 at its bottom to the milling chamber 4. In the embodiment in FIG. 8, the colliding member 12 is secured by bolts 14 to sidewalls of the milling chamber 4.

In the embodiments shown in FIGS. 7 and 8, it is preferable that the conic portion 20 of the colliding members 11, 12 contact a cylindrical edge side of base portions 22. It is also preferable that the conic top portion 20 is directly faced towards the collision position 18 shown for example in FIG. 4. The radius of the conic portions 20 may range from 2 to 200 mm, and may have a height of 50-100 mm. As for a cylindrical radius of the conic portions 20, a radius of 2-100 mm may be preferable, and as for a height for a cylindrical colliding member, a height of 5-100 mm may be preferable.

It may also be desirable to make the height of the collision members 11, 12, adjustable, which is the function of the base portions 15 in FIG. 7. That is, the base portions 15 in FIG. 7 are removable portions so that the number of base portions 15 can be changed, to alter the height of the colliding member 11.

In the embodiment of FIG. 8, the entire colliding member 12 is secured together by bolt 16. In the embodiment of FIG. 8, height adjustment can also be realized by forming the colliding member 12 of plural cylinders, the number of which is adjustable, and then securing the entire device by the bolt 16.

In the above-noted embodiments bolts have been indicated as a mechanism to secure the colliding members 11, 12 at a desired position. Of course many other types of securing mechanisms can be implemented.

Other methods of adjusting the heights of the colliding members are of course also possible.

Figure 6:
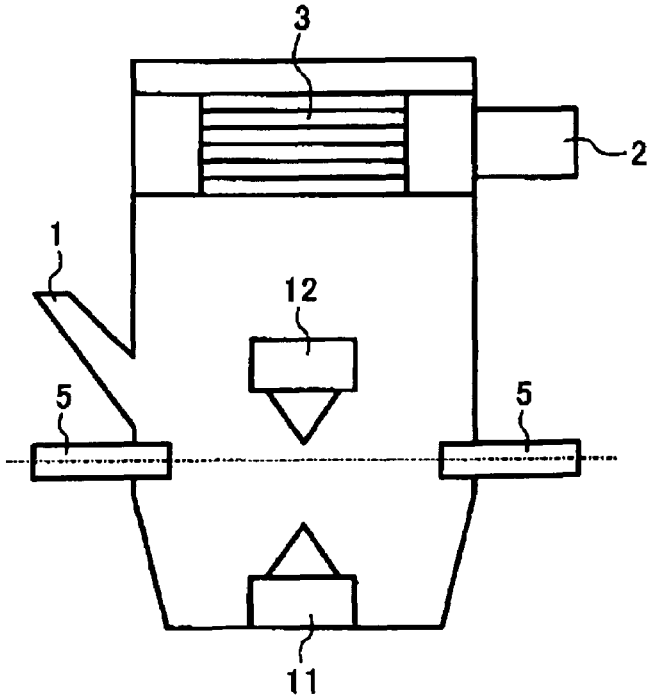
FIG. 6 is a cross-sectional view of an embodiment of a fluidized bed-type pulverization apparatus of the present invention.

In the different embodiments shown in FIGS. 4-6, the colliding members 11, 12 can be positioned at different points in the milling chamber 4. It is preferable that the colliding members 11, 12 in the horizontal direction are positioned at substantially the center of the milling chamber 4, in the vertical direction it is preferable that the colliding members 11, 12 are positioned a distance of a diameter at an exit from the air nozzles 5 from the position of the first collision (point 18) where compressed air is jetted from the air nozzles 5.

The conic top of the colliding members 11, 12 is preferably 10-500 mm right above or right below the noted first collision point 18, and is more preferably 10-300 mm above or below, and is most preferably 10-200 mm above or below.

It may also be preferable that the colliding members 11, 12 are detachable, again for example by the bolts 13, 14 in FIGS. 7 and 8. Such a structure allows adjustment for the preparation of any changing conditions such as in the amount of processing and the mean particle size of raw particles input into the milling chamber 4. Such an operation also allows shortening of any time needed to make any changes in the milling chamber 4.

It may also be preferable to make the faces of the collision members 11, 12 resistant to abrasion. As one example, the collision members 11, 12 can have a hard-face lining with Ti. Abrasion-resistance colliding members may be beneficial in realizing more effective pulverization.

In the embodiments of the present invention noted above, it may be preferable to set the pressure of compressed air supplied from the air nozzles 5 to 0.2-1.0 mPa. If the original air pressure is in such a range, desired pulverizing efficiency may more reliably be obtained. When the original pressure is less than 0.2 MPa, the pressure of the compressed air may be too low, which may give rise to inadequate pulverizing of the particles. Further, if the original air pressure is too high, the ratio of pulverized particles that are in fact too small may increase; that is, too high a percentage of the particles may be overpulverized. Further, if the original air pressure is too high, a loss of speed may result by generating collision waves in the flow of air generated from the air nozzles 5.

After the particles are pulverized in the pulverizing apparatuses of the present invention, the particles flow into the rotor 3, which is rotating, and the rotor 3 can classify particles by centrifugal force into fine powder and coarse particles. It is preferable to set the rotor 3 in the upper part of the milling chamber 4 as shown for example in FIGS. 4-6 in the present specification as crushed fine particles and raw particles will flow directly into the inside of the rotor 3 from the milling chamber 4, to thereby be classified into raw and fine particles.

Particles that have been pulverized will flow into the rotor 3 by virtue of aspiration through the exhaust tube 2, which can include an aspirating fan (not shown). That is, an aspirating fan in the exhaust tube 2 can be activated so that particles move towards the exhaust tube 2, and thereby flow into the rotor 3 set up in the upper part of the milling chamber 4. Then, the particles can be classified by size by the rotating rotor 3.

At that time, pulverized particles that are smaller than a desired particle size can be exhausted through the exhaust tube 2. On the other hand, pulverized particles that are still larger than a desired particle size may be lead outside of the rotor 3 by centrifugal force of the rotor 3, and will move downward along the wall of the milling chamber 4 to then be crushed again.

As for the rotational peripheral velocity of the rotor 3, 20-70 m/s is desirable, and 30-60 m/s may be more desirable. If the rotational peripheral velocity is maintained within such ranges, efficiency of classification can be achieved to an extent desired. When the rotational peripheral velocity of the rotor 3 is less than 20 m/s, the possibility that inefficient classification results is increased. When the rotational peripheral velocity of the rotor 3 is greater than 70 m/s, centrifugal force of the rotor 3 may grow to be too great, and thereby particles that should be exhausted through the exhaust tube 2 will return to the milling chamber 4 again, and then again be crushed. As a result, too many small particles may be generated, that is overpulverizing may result.

In the pulverizing apparatus as discussed above with respect to the present invention, and with reference to FIG. 9 in the present specification as an example, the plural air nozzles 5 can be positioned equidistant along the milling chamber 4. The non-limiting embodiment shown in FIG. 9 shows three air nozzles 5 being utilized, although as noted above the number of air nozzles implemented can be varied.

Also, it is preferable if those air nozzles 5 are formed at a same height position on the milling chamber 4.

The pulverizing apparatuses of the present invention noted above operate a pulverizing method in which raw particles are supplied by a raw particle feeder 1, crushed fine particles are drained from the exhaust tube 2, and continuous pulverizing is enabled by supplying particles of a quantity corresponding to the quantity of the drained particles appropriately.

Having generally described the present invention, further understanding can be obtained by reference to certain specific examples provided herein for the purpose of illustration only, and that are not intended to be limiting. In the descriptions in the following examples, the numbers represent weight ratios in parts, unless otherwise specified.

EXAMPLES

In the following examples, the following raw particles were used.

The raw particles were a compound in styrene acrylic copolymer resin 85 weight part and carbon black 15 weight part that was melt kneaded, cooled, and pulverized with a hammer mill roughly.

Example 1

Preparation of Pulverizing Apparatus:

A pulverizing apparatus as shown in FIG. 3 and a rotor as shown in FIG. 1 with a rotor specification were prepared as follows.

Rotor:

external diameter: 100 mm width of each blade of the rotor: 1/50 of rotor diameter=2 mm Length of each blade: 1/20 of rotor diameter=5 mm Angle of each blade: 0°

Pagination of blades: 50

Number of rotors: 1

Internal diameter of Milling chamber: 250 mm

Height of pulverizing apparatus: approximately 900 mm

Air nozzle exit diameter: 6.5 mm

Number of air nozzles: 3

The air nozzles were placed at equal intervals (equiangular degree) along the wall of milling chamber 4. To be suitable for 0° from horizontal direction, the direction of the exit of air nozzles 5 was set.

With the above-mentioned crushing device in this example, air nozzles 5 were set at the position of the first collision such that point 18 (FIG. 4) became the center axis of most of the initial crushing in the milling chamber.

One rotor was set above the centerline of the air nozzles 5 about 450 mm.

Particles of the above-mentioned composition were supplied on the following conditions, and the particles were pulverized.

Former pressure of compressed air supplied to air nozzles 5: 0.5 MPa

Rotation peripheral velocity of rotor 3: 30 m/s

One rotor was set above the centerline of the air nozzles 5 about 450 mm above.

Particles of the above-mentioned composition were supplied on the following conditions, and the particles were pulverized.

Original pressure of compressed air supplied to the air nozzles 5: 0.5 MPa

Rotation peripheral velocity of rotor 3: 30 m/s

Obtained fine particles were as follows.

Volume average particle size: 6.05 μm (MULTICIZER by Coulter Electronics)

Fine particles content rate of 4 μm or less (piece several %): 64.5%

Rate of raw particles content of 16 μm or more (weight %): 1.2%

Amount of pulverizing processing: 12.9 kg/hr

Example 2

The same device as in example 1 except also including a first secondary collision member 11.

The centerline of the air nozzles 5 set up below the first collision member 11 from the intersecting position (the position 18: compressed air first collides mutually attended with particles) right under 60 mm mutually as shown in FIG. 4.

Particles of the above-mentioned composition were supplied on the following conditions, and the particles were pulverized.

Original pressure of the compressed air supplied to air nozzles 5: 0.5 MPa

Rotation peripheral velocity of rotor 3: 30 m/s

Obtained fine particles were as follows.

Volume average particle size: 5.96 μm (MULTICIZER by Coulter Electronics)

Fine particles content rate of 4 μm or less (piece several %)

:65.6%

Rate of row particles content of 16 μm or more (weight %): 1.1%

Amount of pulverizing processing: 14.2 Kg/hr

Example 3

The same device as in example 1 except including secondary collision member 12.

As shown in FIG. 5, the collision plate member 12 was installed at a position 60 mm above the centerline of the air nozzles 5 intersected mutually.

Particles of the above-mentioned composition were supplied on the following conditions, and the particles were pulverized.

Original pressure of the compressed air supplied to air nozzles 5: 0.5 MPa

Rotation peripheral velocity of rotor 3: 30 m/s

Obtained fine particles were as follows.

Volume average particle size: 5.88 μm (MULTICIZER by Coulter Electronics)

Fine particles content rate of 4 μm or less (piece several %): 66.5%

Rate of row particles content of 16 μm or more (weight %): 1.05%

Amount of pulverizing processing: 14.2 Kg/hr

Example 4

The same device as in example 1 except including both a first secondary collision member 11 and a second secondary collision member 12, as shown in FIG. 6.

The centerline of the air nozzles 5 set up the first collision member 11 from the intersecting position (The position 18: compressed air first collides mutually attended with particles) right under 60 mm mutually as shown in FIG. 4. The second collision member 12 was installed from the position right above 60 mm in which the centerline of air nozzle 5 intersected mutually.

Particles of the above-mentioned composition were supplied on the following conditions, and particles were pulverized.

Original pressure of compress air supplied to air nozzle 5: 0.5 MPa

Rotation peripheral velocity of rotor 3: 30 m/s

Obtained fine particles were as follows.

Volume average particle size: 5.75 μm (MULTICIZER by Coulter Electronics)

Fine particles content rate of 4 μm or less (piece several %): 67.7%

Rate of row particles content of 16 μm or more (weight %): 0.9%

Amount of pulverizing processing: 16.8 Kg/hr

Example 5

The procedure for preparation of the pulverizing apparatus in Example 2 was repeated except that the first collision member 11 was replaced with a detachable first collision member.

After the pulverization, the chamber was cleaned.

The time required for cleaning was reduced by about 10% in comparison with the apparatus in Example 2.

Example 6

The procedure for preparation of the pulverizing apparatus in Example 3 was repeated except that the secondary collision member 12 was replaced with a detachable secondary collision member.

After the pulverization, the chamber was cleaned.

The time required for cleaning was reduced by about 10% in comparison with the apparatus shown in Example 3.

Example 7

The procedure for preparation of the pulverizing apparatus in Example 2 was repeated except that the first collision member 11 was replaced with an abrasion-resistant first collision member.

Preparation of abrasion-resistant first collision member 11 dispensing lining method with Ti.

Pulverization particles with a pulverization apparatus with abrasion-resistant first collision member 11, resulted in the effect of the abrasion resistance doubled roughly compared with a background apparatus.

Example 8

The procedure for preparation of the pulverizing apparatus in Example 3 was repeated except that the second collision member 12 was replaced with an abrasion-resistant second collision member.

Preparation of abrasion-resistant second collision member 12 including dispensing a lining method with Ti.

Pulverization particles with a pulverization apparatus with abrasion-resistant second collision member 12, resulted in the effect of the abrasion resistance has doubled roughly compared with a background apparatus.

Comparative Example 1

The procedure for preparation of the pulverizing apparatus and pulverization condition in Example 1 were repeated except that: width of each blade of the rotor: 1/50 of rotor diameter=2 mm, Length of each blade: 1/20 of rotor diameter=5 mm, Pagination of blades: 50, were replaced with width of each blade of the rotor: 1/1000 of rotor diameter=1 mm Length of each blade: 1/10 of rotor diameter=10 mm, Pagination of blades: 60.

Obtained fine particles were as follows.

Volume average particle size: 6.32 μm (MULTICIZER by Coulter Electronics)

Fine particles content rate of 4 μm or less (piece several %): 61.5%

Rate of raw particles content of 16 μm or more (weight %): 1.5%

Amount of pulverizing processing: 9.9 Kg/hr

Comparative Example 2

The procedure for preparation of the pulverizing apparatus and pulverization condition in Example 1 were repeated except that: width of blade which construct rotor: rotor diameter of 1/50=2 mm, Length of blade: rotor diameter of 1/20=5 mm, were replaced with width of each blade of rotor: 1.5/100 of rotor diameter=1.5 mm Length of blade: 1/100 of rotor diameter=1 mm.

Obtained fine particles were as follows.

Volume average particle size: 6.53 μm (MULTICIZER by Coulter Electronics)

Fine particles content rate of 4 μm or less (piece several %): 57.07%

Rate of raw particles content of 16 μm or more (weight %): 2.1%

Amount of pulverizing processing: 11.4 Kg/hr

The present application claims priority and contains subject matter related to Japanese patent application No. 2004-219990 filed on Jul. 28, 2004, the entire contents of which are hereby incorporated herein by reference.

Obviously, numerous additional modifications and variations of the present invention are possible in light of the above teachings. It is therefore to be understood that within the scope of the appended claims, the present invention may be practiced otherwise than as specifically described herein.

The invention claimed is:

1. A pulverizing apparatus comprising:

plural air nozzles;

a chamber configured to pulverize particles by compressed air jetted from the plural air nozzles;

a rotor set in an upper part of the crushing chamber, configured to classify particles that flow into the rotor from the chamber into fine particles and raw particles by centrifugal force, wherein the rotor comprises plural blades set to each have a width of 1/50-2/25 of a diameter of the rotor, wherein a length of each of the plural blades of the rotor is 1/25-3/50 of the diameter of the rotor, wherein each of the plural blades forms a gap with a neighboring of the plural blades set to 1/25-3/25 of the diameter of the rotor, and wherein each of the plural blades has an angle of 0-30 degrees against a rotating direction of the rotor.

2. The pulverizing apparatus according to claim 1, comprising 1-6 rotors.

3. The pulverizing apparatus according to claim 1, further comprising a collision member configured to secondarily pulverize the particles.

4. The pulverizing apparatus according to claim 3, wherein the collision member is set below or above a first collision point where the compressed air contacts the particles.

5. The collision member according to claim 4, wherein the collision member comprises a circular conic part and a cylindrical part.

6. The pulverizing apparatus according to claim 5, wherein a top of the conic part of the collision member is positioned 10-500 mm above or below the first collision point.

7. The pulverizing apparatus according to claim 4, wherein the collision member is configured to be adjustably positioned.

8. The pulverizing apparatus according to claim 4, wherein the collision member is detachable.

9. The pulverizing apparatus according to claim 4, wherein the collision member has abrasion resistance.

10. The pulverizing apparatus according to claim 1, wherein the plural air nozzles comprise 2-8 air nozzles.

11. The pulverizing apparatus according to claim 1, wherein the plural air nozzles are positioned equidistantly at a concentric circle around a central axis in a lengthwise direction of the chamber.

12. The pulverizing apparatus according to claim 11, wherein the plural air nozzles are positioned equidistantly at the concentric circle.

13. The pulverizing apparatus according to claim 1, wherein a gradient of an output direction of the plural air nozzles is less than 20 degrees from an even level.

14. The pulverizing apparatus according to claim 13, wherein a gradient of an output direction of the means for supplying air is less than 20 degrees from an even level.

15. A pulverizing apparatus comprising:

means for supplying air;

means for pulverizing particles by compressed air jetted from the means for supplying air;

means, set in an upper part of the means for pulverizing, for classifying particles from the means for pulverizing into fine particles and raw particles by centrifugal force, wherein the means for classifying comprises plural blades set to each have a length of 1/25-3/25 of a diameter of the rotor, wherein each of the plural blades forms a gap with a neighboring of the plural blades set to 1/25-3/25 of the diameter of the rotor, and wherein each of the plural blades has an angle of 0-30 degrees against a rotating direction of the rotor.

16. The pulverizing apparatus according to claim 15, wherein the means for classifying comprises 1-6 rotors.

17. The pulverizing apparatus according to claim 15, further comprising collision means for secondarily pulverizing the particles.

18. The pulverizing apparatus according to claim 15, wherein the means for secondarily pulverizing is set below or above a first collision point where the compressed air contacts the particles.

19. The collision member according to claim 18, wherein the means for secondarily pulverizing comprises a circular conic part and a cylindrical part.

20. The pulverizing apparatus according to claim 19, wherein a top of the conic part of the means for secondarily pulverizing is positioned 10-500 mm above or below the first collision point.

21. The pulverizing apparatus according to claim 18, wherein the means for secondarily pulverizing is configured to be adjustably positioned.

22. The pulverizing apparatus according to claim 18, wherein the means for secondarily pulverizing is detachable.

23. The pulverizing apparatus according to claim 18, wherein the means for secondarily pulverizing has abrasion resistance.

24. The pulverizing apparatus according to claim 15, wherein the means for supplying air comprises 2-8 air nozzles.

25. The pulverizing apparatus according to claim 15, wherein the means for supplying air is positioned at a concentric circle around a central axis in a lengthwise direction of the means for pulverizing.

26. The pulverizing apparatus according to claim 25, wherein the means for supplying air is positioned equidistantly at the concentric circle.

* * * * *